US006752495B2

(12) United States Patent
Izuma

(10) Patent No.: US 6,752,495 B2
(45) Date of Patent: Jun. 22, 2004

(54) IMAGE FORMING DEVICE

(75) Inventor: Kensuke Izuma, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 115 days.

(21) Appl. No.: 10/220,524

(22) PCT Filed: Apr. 26, 2001

(86) PCT No.: PCT/JP01/03602

§ 371 (c)(1),
(2), (4) Date: Aug. 28, 2002

(87) PCT Pub. No.: WO01/83344

PCT Pub. Date: Nov. 8, 2001

(65) Prior Publication Data

US 2003/0030713 A1 Feb. 13, 2003

(30) Foreign Application Priority Data

Apr. 28, 2000 (JP) ..... 2000-134290

(51) Int. Cl.[7] ..... B41J 2/01; B41J 29/13; A63F 3/00

(52) U.S. Cl. ..... 347/108; 347/104; 271/275

(58) Field of Search ..... 347/104, 108, 347/4; 271/274, 275; 400/691; 355/14 SH

(56) References Cited

U.S. PATENT DOCUMENTS 4,268,163 A * 5/1981 Doi et al. ..... 399/121
6,467,901 B2 * 10/2002 Von Inten ..... 347/104

FOREIGN PATENT DOCUMENTS

| | | |
|---|---|---|
| JP | 5-213476 | 8/1993 |
| JP | 7-157132 | 6/1995 |
| JP | 2000-16623 | 1/2000 |
| JP | 2000-44085 | 2/2000 |

* cited by examiner

*Primary Examiner*—Stephen D. Meier
*Assistant Examiner*—Alfred Dudding
(74) *Attorney, Agent, or Firm*—Dellett & Walters

(57) ABSTRACT

A first lever 70 is linked to coupling unit 60 to couple and decouple a pair of rollers 26, 30 which pinch and deliver a recording sheet 20 in a delivery direction toward an image-forming zone for image formation. This first lever 70 is placed near an inlet port 16.

7 Claims, 10 Drawing Sheets

IMAGE FORMING DEVICE

TECHNICAL FIELD

The present invention relates to an image-forming apparatus for forming an image on a long recording sheet wound in a roll, or a like state.

BACKGROUND TECHNIQUE

Conventionally, long recording sheets wound upon a core tube (hereinafter referred to as "rolled recording sheet") are used widely as the recording sheet for image formation with an image-forming apparatus. Usually, to feed the rolled recording sheet to the image-forming apparatus, a holder for holding the roll of the recording sheet is provided on the rear side of the main body of the image-forming apparatus. On the rear side, an inlet port is provided for feeding the rolled recording sheet from the holder. On the front side of the main body of the apparatus, an outlet port is provided for discharging the recording sheet after image formation. Between the inlet port and the outlet port, an image-forming zone is provided for image formation on the rolled recording sheet.

Between the inlet port and the image-forming zone, a pair of rollers are placed to pinch and deliver the rolled recording sheet to the image-forming zone. The roller pair consists of a driving roller and a driven roller placed above. The driven roller is made movable upward and downward to be coupled to or decoupled from the driving roller. A manipulating lever is provided near the outlet port to move the driven roller upward and downward. The rolled recording sheet is pinched by the driving roller and the driven roller and is delivered with rotation of the driving roller.

For image formation on the rolled recording sheet, the rolled recording sheet is delivered stepwise by the driving roller and the driven roller by one printing band width. After the formation of the one printing band portion of the image, the rolled recording sheet is delivered further by the one printing width. On the newly delivered portion of the recording sheet, a next printing band portion of the image is formed. Such operations are repeated to form the entire image. The rolled recording sheet is then delivered to be discharged from the outlet port.

When the rolled recording sheet held by the roll holder has been used up entirely or a like case, the core tube left on the holder is taken out, and a fresh recording sheet roll is set to the holder. Before formation of an image on this fresh rolled-recording sheet, the rolled recording sheet should be pinched between the driving roller and the driven roller. For pinching the recording sheet between the driving roller and the driven roller, firstly a manipulating lever is handled to displace the driven roller upward to be decoupled from the driving roller (Step 1); with the driven roller kept decoupled from the driving roller, the front end portion on the outermost face of the rolled recording sheet is introduced through the inlet port (Step 2); then the front end portion is inserted between the driving roller and the driven roller (Step 3); and finally the driven roller is lowered by handling the manipulating lever to press the driving roller through the rolled recording sheet (Step 4). Thus, the rolled recording sheet is pinched between the driving roller and the driven roller to be ready for delivery to the image-formation zone.

In the aforementioned operation for delivery of the fresh rolled recording sheet to the image formation zone, the user conducts the above Step 1 at the front side of the apparatus, thereafter the user moves to the rear side of the apparatus to practice the above Step 2 and Step 3, and further the user moves again to the front side of the apparatus again to practice the above final Step 4.

With conventional image-forming apparatuses, as described above, the user has to move between the front side and rear side of the apparatus for replenishment of the rolled recording sheet and delivery of the fresh rolled recording sheet to the image formation zone. This is inconvenient and inefficient in the operation.

DISCLOSURE OF INVENTION

Under the aforementioned circumstances, the present invention intends to provide an image-forming apparatus improved in operability.

For achieving the above object, a first embodiment of the image-forming apparatus of the present invention having a pair of rollers for pinching and delivering a recording sheet in a delivery direction toward an image-forming zone for image formation, the recording sheet being introduced from an inlet port placed at an upstream side of the pair of rollers against the delivery direction and being discharged from an outlet port placed at a downstream side of the image-forming zone along the delivery direction, the image-forming apparatus comprising (1) a coupling unit for coupling and decoupling the pair of rollers, and (2) a first manipulating member placed near the inlet port, and linked to the coupling unit for manipulating the coupling unit.

The image-forming apparatus may comprise (3) a second manipulating member which is placed near the outlet port, and is linked to the coupling unit for manipulating the coupling unit.

The coupling unit may comprise (4) a turning arm linked to both of the first manipulating member and the second manipulating member and being turnable in a prescribed direction and the reverse direction; and (5) a coupling member linked to the turning arm, for decoupling the pair of rollers by turning the turning arm in the prescribed direction and coupling the pair of rollers by turning the turning arm in the reverse direction.

The image-forming apparatus may comprise (6) a third manipulating member, instead of the first manipulating member, formed in integration with the turning arm, and placed near the inlet port.

A second embodiment of the image-forming apparatus of the present invention having a coupleable rollers for pinching and delivering a recording sheet in a delivery direction toward an image-forming zone for image formation, the recording sheet being introduced from an inlet port placed at an upstream side of the pair of rollers against the delivery direction and being discharged from an outlet port placed at a downstream side of the image-forming zone along the delivery direction, the image-forming apparatus comprising (7) a manipulating member taking either a coupling position for coupling the pair of rollers or a decoupling position for decoupling the pair of rollers and being energized to take the coupling position, for manipulating the pair of rollers;

(8) a turning arm linked to the manipulating member to be, turnable;

(9) a coupling member linked to the turning arm to decouple the pair of rollers with the manipulating member set at the decoupling position and to couple the pair of rollers with the manipulating member set at the coupling position; and

(10) a first locking means placed near the inlet port for locking the turning arm not to turn with the manipulating member set at the decoupling position.

The image-forming apparatus of the second embodiment may comprise

(11) a releasing means placed near the inlet port for releasing the turning arm from locking by the first locking means.

A third embodiment of the image-forming apparatus of the present invention having a pair of coupleable rollers for pinching and delivering a recording sheet in a delivery direction toward an image-forming zone for image formation, and the recording sheet being introduced from an inlet port placed at an upstream side of the pair of rollers against the delivery direction and being discharged from an outlet port placed at a downstream side of the image-forming zone along the delivery direction, the image-forming apparatus comprising

(12) a first manipulating member placed near the inlet port for coupling and decoupling the pair of rollers;

(13) a second manipulating member placed near the outlet port for coupling and decoupling the pair of rollers;

(14) a turning arm linked to both of the first manipulating member and the second manipulating member and being turnable in a prescribed direction and the reverse direction;

(15) a coupling member linked to the turning arm, for decoupling the pair of rollers by turning the turning arm in the prescribed direction and coupling the pair of rollers by turning the turning arm in the reverse direction;

(16) a second locking means for locking one of the first manipulating member and the second manipulating member when the pair of rollers are coupled.

(17) The second locking means may be an openable cover which is openable at an upper part of the main body of the image-forming apparatus, and the openable cover prevents turn of the first manipulating member or the second manipulating member to lock the manipulating means when the openable cover is closed.

A fourth embodiment of the image-forming apparatus of the present invention having a driving roller for delivering a recording sheet in a delivery direction toward an image formation zone, a turnable arm extending in a direction nearly parallel to the delivery direction above the driving roller, and a driven roller fixed rotatably to the turnable arm and capable of coupling with the driving roller, the recording sheet being introduced from an inlet port placed at an upstream side of the driving roller against the delivery direction and being discharged from an outlet port placed at a downstream side of the image-forming zone along the delivery direction, the image-forming apparatus comprising

(18) a turnable shaft extending in a direction crossing the turnable arm above the driven roller;

(19) a bearing for supporting one end of the turnable shaft;

(20) a pushing cam which pushes the turnable arm with turn of the turning shaft in the prescribed direction to lift the driven roller above the driving roller, and couples the driven roller with the driving roller with turn of the turning shaft in the direction reverse to the prescribed direction;

(21) a turning arm lever having a connecting end connected to the other end of the turning shaft, a turning arm extending downward from the connecting end in a direction approximately perpendicular to the turning shaft, and a third lever extending from the connecting end to vicinity of the inlet port at the upstream side against the delivery direction;

(22) a second arm having a first end connected to a bottom end of the turning arm, and a second end placed downstream after the first end along the delivery direction; and

(23) a second manipulating member having a turning end fixed in a turnable manner near the outlet port and connected to the second arm at the second end.

A fifth embodiment of the image-forming apparatus having a driving roller for delivering a recording sheet in a delivery direction toward an image formation zone, a turnable arm extending in a direction nearly parallel to the delivery direction above the driving roller, and a driven roller fixed rotatably to the arm and capable of coupling with the driving roller, the recording sheet being introduced from an inlet port placed at an upstream side of the driving roller against the delivery direction and being discharged from an outlet port placed at a downstream side of the image-forming zone along the delivery direction, the image-forming apparatus comprising

(24) a turnable shaft extending in a direction crossing the arm above the driven roller;

(25) a bearing for supporting one end of the turnable shaft;

(26) a pushing cam which pushes the arm with turn of the turning shaft in the-prescribed direction to separate the driven roller upward from the driving roller, and couples the driven roller with the driving roller by turn of the turning shaft in the direction reverse to the prescribed direction;

(27) a turning arm having a upper end connected to the other end of the turning shaft and extending downward from the upper end in a direction approximately perpendicular to the turning shaft and being turnable around the upper end;

(28) a protrusion formed at the bottom end of the turning arm to protrude therefrom;

(29) a second arm having a first end connected to a lower end of the turning arm, and a second end placed downstream after the first end along the delivery direction;

(30) a second manipulating member having a turning end fixed in a turnable manner near the outlet port and connected to the second arm at the second end;

(31) a pulling coil spring which is placed in the upstream before the second manipulating member pulls the second manipulating member in the upstream direction against the delivery direction to energize the turning arm to turn in the reverse direction; and

(32) a stopper which is placed near the inlet port and locks the turning arm by hooking the protrusion of the turning arm when the turning arm is turned in the prescribed direction.

The image-forming apparatus of this embodiment may be provided with

(33) a stopper-releasing device, and

(34) a releasing device controller for controlling the stopper-releasing device.

BEST MODE FOR CARRYING OUT THE INVENTION

The embodiments of the image-forming apparatus of the present invention are explained below by reference to drawings.

The constitution of a color plotter (hereinafter referred simply to as a "plotter") of a first embodiment of the image-forming apparatus of the present invention is briefly explained below by reference to FIGS. 1 and 2.

Figure 1:
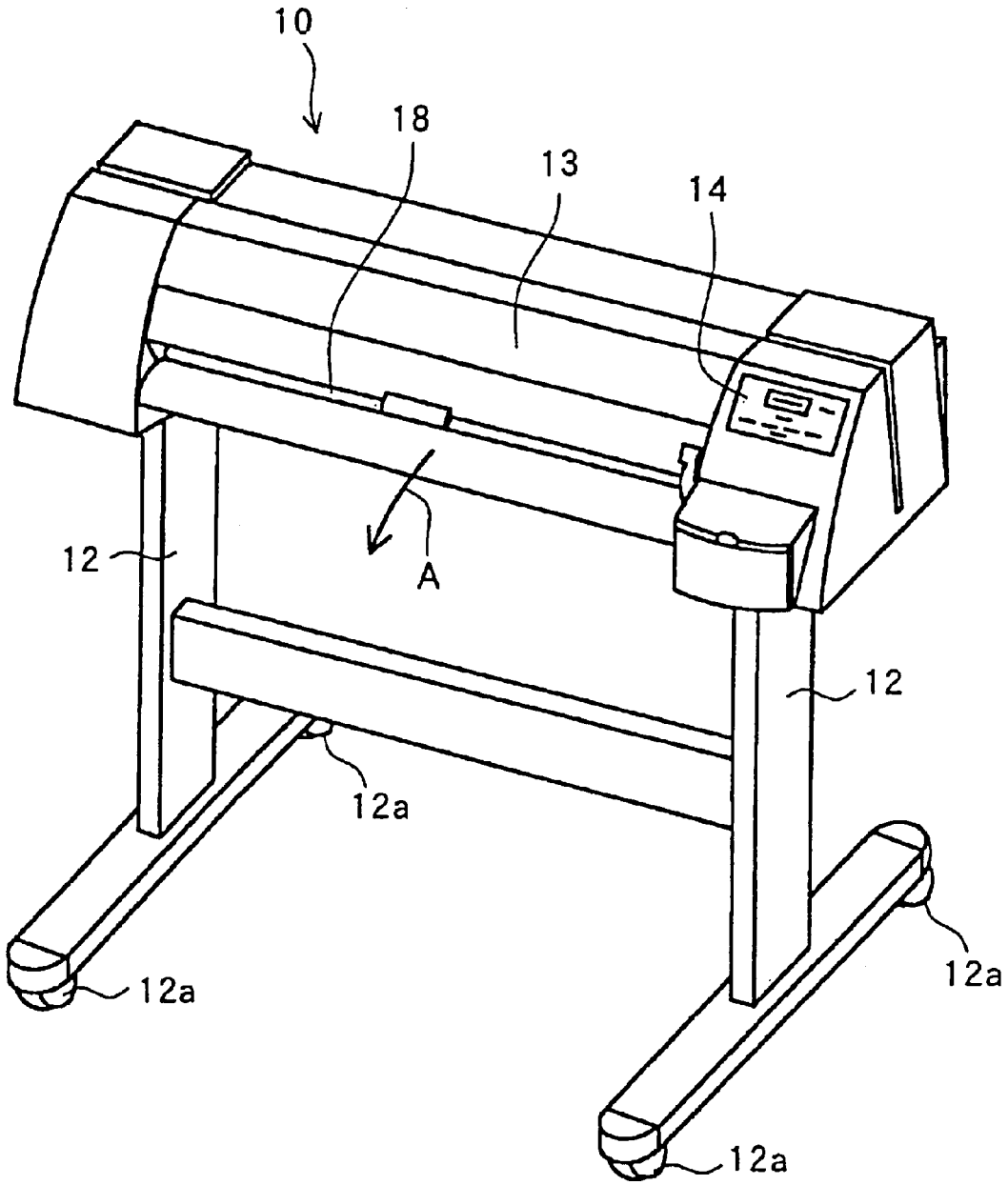
FIG. 1 is a perspective view showing schematically the constitution of a color plotter, an image-forming apparatus, taken from the front side.

FIG. 1 is a perspective view of a plotter, taken from the front side. FIG. 2 is a perspective view of the plotter shown in FIG. 1, taken from the rear side.

The plotter 10 is mounted onto a stand 12 having casters 12*a*. The plotter 10 has a control unit 14 for controlling the plotter 10 to select the paper size, on-line/off-line, and commands. In the upper part of the main body of the plotter 10, a cover openable upward is provided which covers and uncovers the interior of the main body (the openable cover 13 is an example of a second locking means in the present invention).

A recording paper sheet (an example of the recording sheet in the present invention) is introduced through an inlet port 16 provided on the rear side of the plotter 16 for inserting the recording paper sheet. Inside near the inlet port 16, there are placed a driving roller 26 (see FIG. 3) and a driven roller 30 (see FIG. 3) in a pair. The driving roller 26 and the driven roller 30 are an example of the pair of rollers in the present invention.

The recording paper sheet introduced through the inlet port 16 in the arrow A direction (see FIG. 2) is delivered in the delivery direction (in the same direction as shown by the arrow A) into the plotter 10 by the driving roller 26 and the driven roller 30 in accordance with the instruction given by the control unit 14. Inside the plotter, an image-forming zone 32 (see FIG. 3) is provided for formation of an image on the recording paper sheet. An outlet port 18 is provided for taking out the recording sheet after image formation on the downstream side along the arrow A direction of the image-forming zone 32 (the front side of the plotter 10). After the image formation in the image-forming zone 32, the recording sheet delivered there is discharged through the outlet port 18 in the arrow A direction.

The path of delivery of the recording paper sheet and the printing process (image formation process) in the plotter 10 is explained below by reference to FIG. 3.

Figure 2:
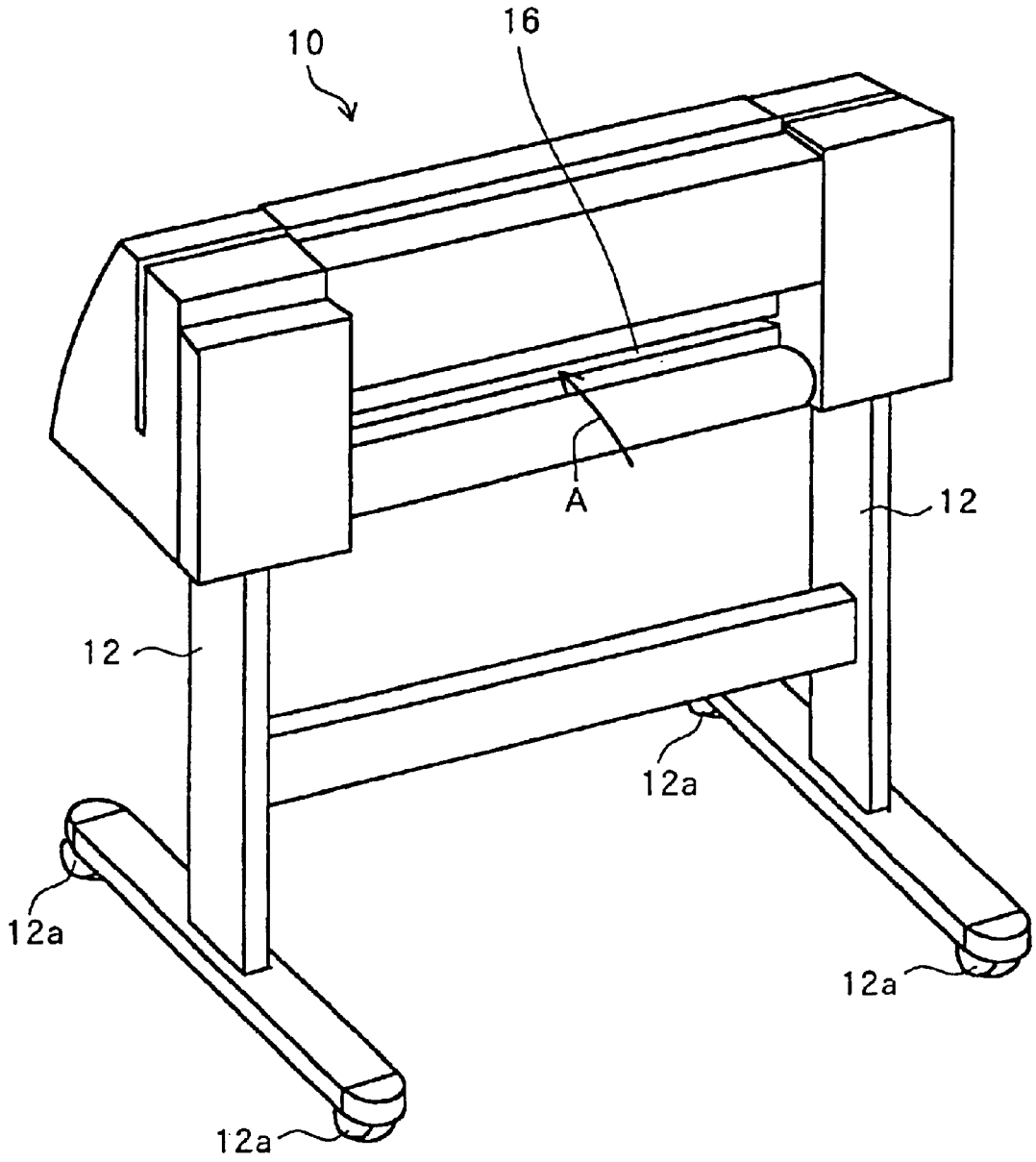
FIG. 2 is a perspective view of the plotter shown in FIG. 1, taken from the rear side.
Figure 3:
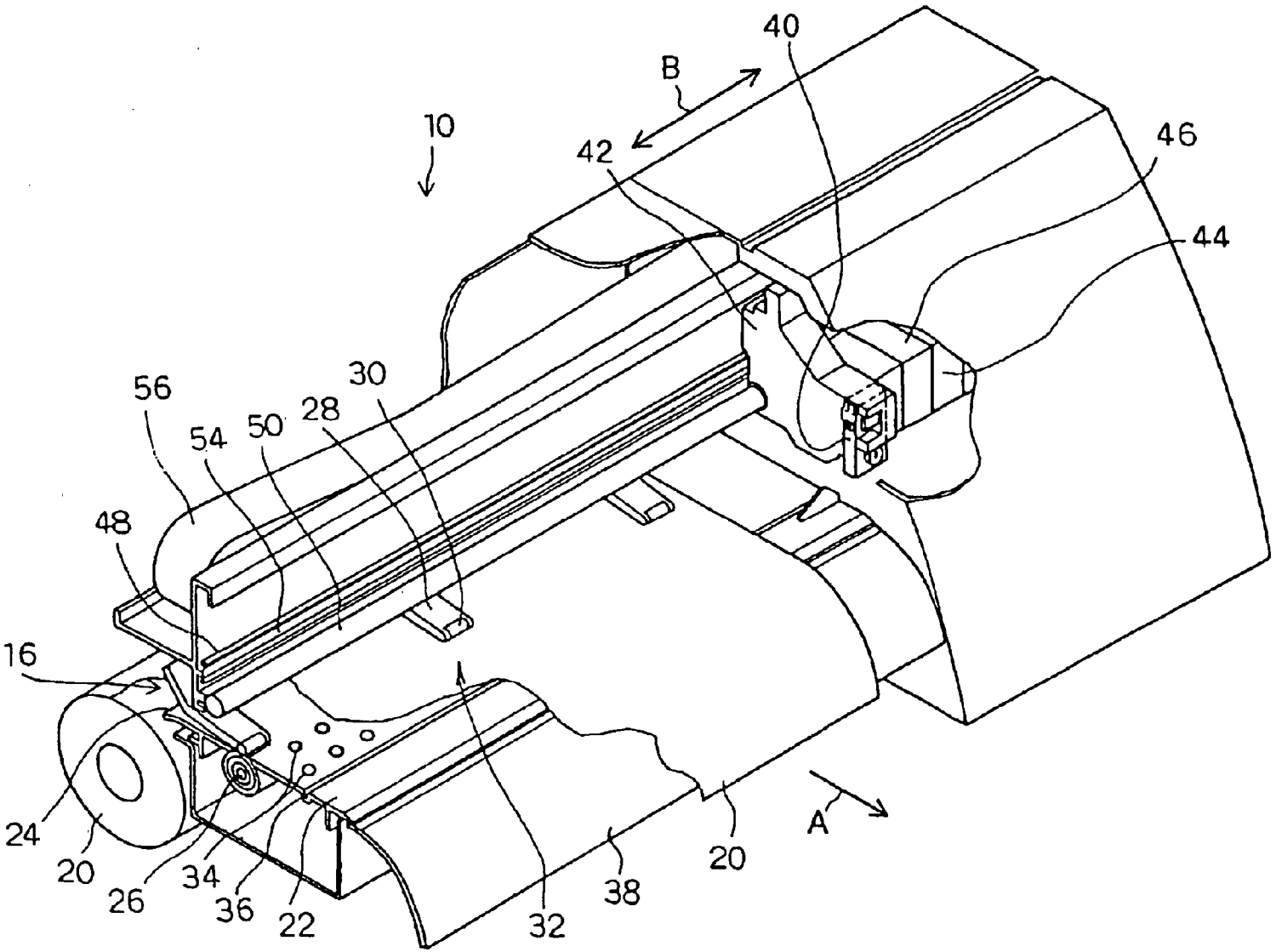
FIG. 3 is a partially cutaway perspective view of a delivery path of a recording sheet in the plotter shown in FIG. 1.

FIG. 3 is a partially cutaway perspective view of a delivery path of a recording sheet in the plotter shown in FIG. 1. In FIG. 3, the same symbols are used for indicating the same constitution elements as in FIG. 1 and FIG. 2.

The plotter 10 is capable of forming an image either on a recording paper sheet in a cut-sheet state or on a continuous recording paper sheet wound in a roll (a rolled paper sheet) 20. Here, explanation is made on the delivery path of the rolled paper sheet inserted through the inlet port 16. However, the cut sheets of the recording paper may also be allowed to pass through the same delivery path.

The front end of the rolled paper sheet 20 is inserted through the inlet port 16 in the arrow A direction (FIG. 2). The inserted paper sheet 20 is delivered over a sheet delivery guide 24 integrated with a platen 22. The image-forming zone 32 is provided on the downstream portion of the platen in the arrow A direction adjacent to the sheet delivery guide 24. The rolled paper sheet 20 having passed over the sheet delivery guide 24 comes to be pinched between the driving roller 26 and the driven roller 30 held rotatably by a driven-roller arm 28 (an example of the arm in the present invention), and is delivered to the image-forming zone 32.

Figure 4:
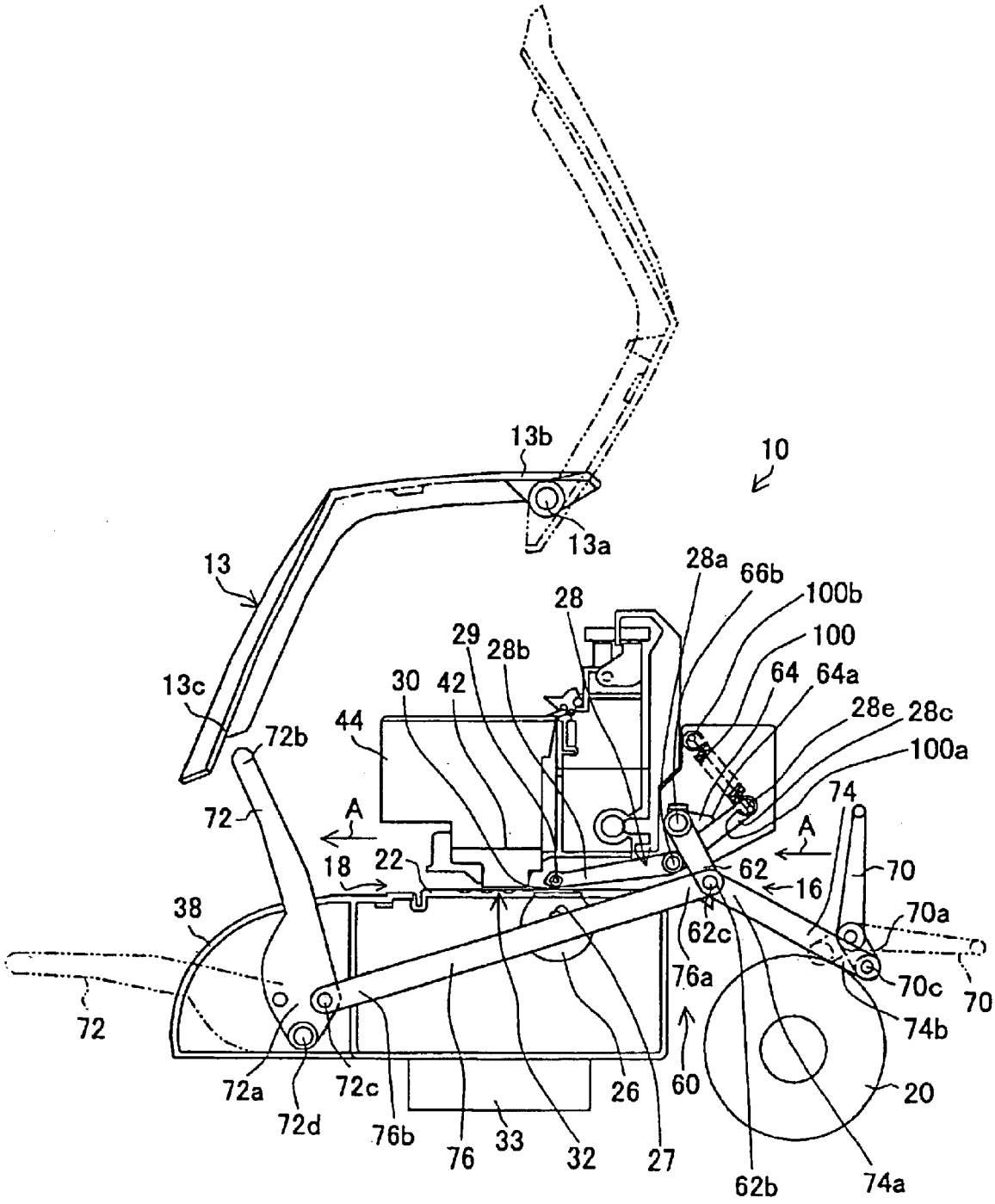
FIG. 4 is a side view showing the inside structure of a plotter of a first embodiment of the present invention.

Below the image-forming zone 32, there is provided a suction fan 33 (FIG. 4). Many suction holes 34 are bored in the platen 22. During delivery of the rolled sheet 20, the suction fan is driven to suck the air through the suction holes 34 to allow the rolled sheet 20 to adhere onto the platen 22 to prevent floating of the rolled paper sheet 20. The rolled paper sheet 20 is kept pinched between the driving roller 26 and the driven roller 30, and is delivered and discharged from the outlet port 18 (FIG. 1) in the arrow A direction.

The plotter 10 has a carriage 42 which reciprocates in the arrow B direction (main scanning direction). This carriage 42 has a head holder 44 on which printing heads 46 containing color inks are mounted (e.g., inks of cyan, magenta, yellow, and black). To this printing heads 46, a flexible cable 56 is connected which transmits ink ejection signals to the printing head 46.

The carriage 42 is fastened to a wire 48 stretched by a carriage-driving motor (not shown in the drawing). This wire 48 reciprocates in the arrow B direction with normal and reverse rotation of the carriage-driving motor. The reciprocating movement of the wire 48 drives the carriage 42 in reciprocation along the guide rail 50 in the arrow B directions. In the carriage 42 at a portion downstream in the delivery direction (arrow A direction), a cutting device 40 is provided detachably. On the platen 22, a groove 36 is provided in which a cutter (not shown in the drawing) of the cutting device 40 is allowed to move. A linear scale 54 extending in the arrow B directions is attached near the guide rail 50 for detection of the position of the carriage 54.

The rolled paper sheet 20 is delivered intermittently in a sub-scanning direction perpendicular to the arrow B direction (arrow A direction, delivery direction). During image formation on the rolled paper sheet 20, the delivery of the rolled paper sheet 20 is temporarily stopped, and one band portion of the image is formed by ejecting an ink from printing head 46 onto the portion of the rolled paper sheet 20 placed on the image-forming zone 32 by moving the carriage 42 in reciprocation in the arrow B direction. Then the rolled paper sheet 20 is delivered by a prescribed sheet length to place a fresh portion of the rolled sheet paper sheet 20 on the image-forming zone 32 for formation of the next printing band portion of the image. This operation is repeated over the entire length of the rolled paper sheet 20 to form a color image on the rolled paper sheet 20. The rolled paper sheet 20 after the image formation is kept pinched between the driving roller 26 and the driven roller 30, and is discharged along the discharge guide 38.

The internal structure of the plotter 10 is explained by reference to FIG. 4 and FIG. 5.

FIG. 4 is a side view showing the internal structure of the plotter. FIG. 5 is an enlarged perspective view of a coupling unit incorporated in the plotter shown in FIG. 4.

Inside the main body of the plotter 10, a driving roller 26 and the driven roller 30 are placed between the image-forming zone and the inlet port 16. Between the inlet port 16 and the outlet port 18, there is provided a coupling unit 60 which moves the driven roller 30 upward from the driving roller 26 to decouple the driven roller 26 from the driving roller 30, and again brings the driven roller 30 downward into pressure-contact with the driving roller 26 (coupling and decoupling). To the coupling unit 60, a first lever 70 (an example of the first manipulating member of the present invention) and a second lever 72 (an example of the second manipulating member of the present invention) are linked.

By opening the cover 13, the carriage 42, the head holder 44, and accessories thereof are uncovered. Thereby, mounting and demounting of the printing head 46 to or from the head holder 44, and other maintenance of the interior of the main body are facilitated.

By closing the cover 13, the carriage 42, the head holder 44, and the like parts are covered by the cover 13, and are protected against the direct shock from the outside. The cover 13 prevents deposition of dust or a foreign matter on the printing head or the like parts, and locks the second lever 72 not to turn, as described later.

The aforementioned driving roller 26 is fixed to the rotation shaft 27 to be rotatable with the rotation shaft 27 perpendicular to the delivery direction (arrow A direction) as the rotation center. This rotation shaft 27 is placed near the image-forming zone 32 below the platen 22. Therefore, most part of the driving roller 26 is below the platen 22, but a part of the driving roller 26 emerges slightly above the upper face of the platen 22. Thereby, the lower face of the rolled recording sheet 20 sucked to adhere to the platen 22 is brought into contact with the driving roller 26.

Above the driving roller 26, a driven-roller arm 28 is placed which extends nearly parallel to the sheet delivery direction. The driven-roller arm 28 is in a shape of a letter "V" having a bend in the middle, and is fixed to the main body of the plotter 10 to be turnable around the bend 28*a* of the V-shaped arm as the turning center. Of the driven-roller arm 28, the tip 28*d* of the portion (downstream-side arm) 28*b* downstream of bending portion 28*a* in the sheet delivery direction is positioned above the driving roller 26. Onto this tip 28*d*, the driven roller 30 is fixed to be rotatable around the rotation shaft 29 nearly parallel to the rotation shaft 27.

Of the driven-roller arm 28, the tip 28*e* of the portion (upstream-side arm) 28*c* upstream of the bending portion 28*a* in the sheet delivery direction is hooked (fixed) by one end 100*a* of a pulling coil spring 100 as shown in FIG. 4. The other end 100*b* opposite to the end 100*a* of the pulling spring 100 is fixed to the main body of the plotter 10 so as to keep the end 100*b* invariably higher than the tip 28*e*. This pulling coil spring 100 pulls the tip 28*e* upward. The driven-roller arm 28 is turnable around the bend portion 28*a*. Therefore, pulling-up of the tip 28*e* of the upstream-side arm 28*c* pushes down the tip 28*d* of the downstream-side arm 28*b*. Thereby, the driven roller 30 attached to the tip 28*d* is kept pressed against the driving roller 26.

The constitution of this coupling unit 60 is explained below which couples the driven roller 30 to the driving roller 26. The coupling unit 60 is constituted of a pushing cam 64 (an example of the coupling member in the present invention), a turning shaft 66 fixing this pushing cam 64, a turning arm 62 in a plate shape connected to the shaft end 66*b* of the turning shaft 66, a first arm 74 in a long narrow plate shape for linking (connecting) the turning arm 62 to the first lever 70, a second arm 76 in a long narrow plate shape for linking the turning arm 62 to the second lever 72, and so forth.

The turning shaft 66 is placed above the driven-roller arm 28, in the shaft length direction shown by the arrow B perpendicular to the sheet delivery direction (an example of crossing direction perpendicular to the arm in the present invention). The one end 66*a* of the turning shaft 66 is supported by a bearing 68 to be turnable.

The other end 66*b* of the turning shaft 66 opposite to the end 66*a* is linked to the upper end 62*a* of the turning arm 62. The direction from the upper end 62*a* to the lower end 62*b* is nearly perpendicular to the direction of the turning shaft 66 (arrow B direction). The turning arm 62 is turnable around the turning shaft 66 in the prescribed direction (arrow C direction in FIG. 5) and the reversed direction (arrow D direction in FIG. 5). The turning shaft 66 is turned by the turning arm 62 in the turning direction of the turning arm 62 by the same turning angle.

The turning shaft 66 has a pushing cam 64 protruding nearly perpendicularly from the turning shaft 66 in opposition to the upstream-side arm 28*c*. The pushing cam 64 is provided such that the angle formed by the protruding direction of the pushing cam 64 perpendicularly from the turning shaft 66 and the direction from the top 62*a* to the bottom 62*b* of the turning arm 62, and the length of the cam 64 from the turning shaft 66 to the tip 64*a* satisfy the following conditions. A first condition is that, when the first lever 70 and the second lever 72 are in a coupling position as shown by the solid lines in FIG. 4, the pushing cam 64 does not push the upstream-side arm 28*c* and the driven roller 30 presses the driving roller 26. A second condition is that, when the first lever 70 and the second lever 72 are respectively in a decoupling position as shown by the two-dot chain lines in FIG. 4, the pushing cam 64 pushes down the upstream-side arm 28*c* to decouple the driven roller 30 from the driving roller 26.

The pushing cam 64 which satisfies the above conditions pushes down the upstream-side arm 28*c* with turn of the turning shaft 66 in the arrow-C direction caused by turn of the turning arm 62 in the arrow-C direction. Thereby the downstream-side arm 28*b* is lifted to separate the driven roller 30 upward from the driving roller 26. On the other hand, when the turning arm 62 is turned in the arrow-D direction reverse to the arrow-C direction to turn the shaft 66 in the arrow-D direction, the upstream-side arm 28*c* is released from the pushing pressure given by the pushing cam 64. Thereby the upstream-side arm 28*c* is pulled up by the pulling coil spring 100 to lower the downstream-side arm 28*b* to couple the driven roller 30 to the driving roller 26.

The first lever 70 for turning the turning arm 62 is placed near the inlet port 16 on the upstream side thereof. The first lever 70 has a bend 70*d* near the one end 70*a* thereof. Thus the first lever 70 is bent there in the shape of a letter "V". The first lever 70 is attached such that the bend 70*d* protrudes toward the downstream of the sheet delivery direction when lever is erected to keep the end 70*a* higher than the end 70*b*. This first lever 70 is fixed to the main body of the plotter 10 to be turnable around the bend 70*d* between the coupling position and the decoupling position.

The first lever 70 is linked to the turning arm 62 by the first arm 74. The one end 74*a* of the first arm 74 and the lower end 62*b* of the turning arm 62 are linked together by a pin 62*c* to be turnable. The other end 74*b* opposite to the end 74*a* is positioned upstream relative to the end 74*a*. This end 74*b* and the bottom end 70*a* of the first lever 70 are joined by a pin 70*c* to be turnable.

A second lever 72 is provided for turning the turning arm 62 near the outlet port 18 in the downstream side thereof. The second lever 72 is linked to the turning arm 62 by a second arm 76. The one end 76*a* is joined to the bottom end 62*b* of the turning arm 62 by a pin 62*c* to be turnable. The end 76*b* opposite to the end 76*a* is situated on the downstream side of the end 76*b* along the delivery direction, and this end 76*b* is joined to the turning end 72*b* of the second lever 72 by a pin 72*c* to be turnable.

The second lever 72 is fixed to a turning shaft 72*d* to be turnable around the turning shaft 72*d* near the tip end of the turning end 72*a* between the coupling position to the decoupling position. When the second lever 72 is erected vertically to bring the tip end 72*b* opposite to the turning end 72*a* at the higher position, the turning shaft 72*d* comes to be positioned downstream after the pin 72*c* in the sheet delivery direction.

The first lever 70 and the second lever 72 are linked to each other by the coupling unit 60 constituted as described above. Further, the driven roller 30 is also interlocked therewith. With the first lever 70 and the second lever 72 placed respectively at the coupling position, the upstream-side arm 28*c* is pulled up by the pulling coil spring 100 since the pushing cam 64 does not push the upstream-side arm 28*c*. In this state, the driven roller arm 28 is forced to turn around the bend portion 28*a* counterclockwise in FIG. 4. Thereby the driven roller 30 presses the driving roller 26. In image formation on the rolled paper sheet 20, the rolled paper sheet 20 pinched between the driven roller 30 and the driving roller 26 is delivered in the arrow A direction with the rotation of the driving roller 26.

When the first lever 70 (or the second lever 72) is pushed from the coupling position to the decoupling position, the second lever 72 (or the first lever 70) is also pushed down to the decoupling position since the first lever 70 and the second lever 72 are linked with each other. For example, by pushing down the first lever 70 to the decoupling position, the first arm 74 is pushed by the end 70*a* of the first lever 70 in the arrow A direction to turn the turning arm 62 clockwise in FIG. 4 (arrow C direction in FIG. 5). This turning movement pushes the second arm 76 in the arrow A direction to turn the second lever 72 conterclockwise in FIG. 4 around the turning shaft 72*d* to the decoupling position.

Figure 5:
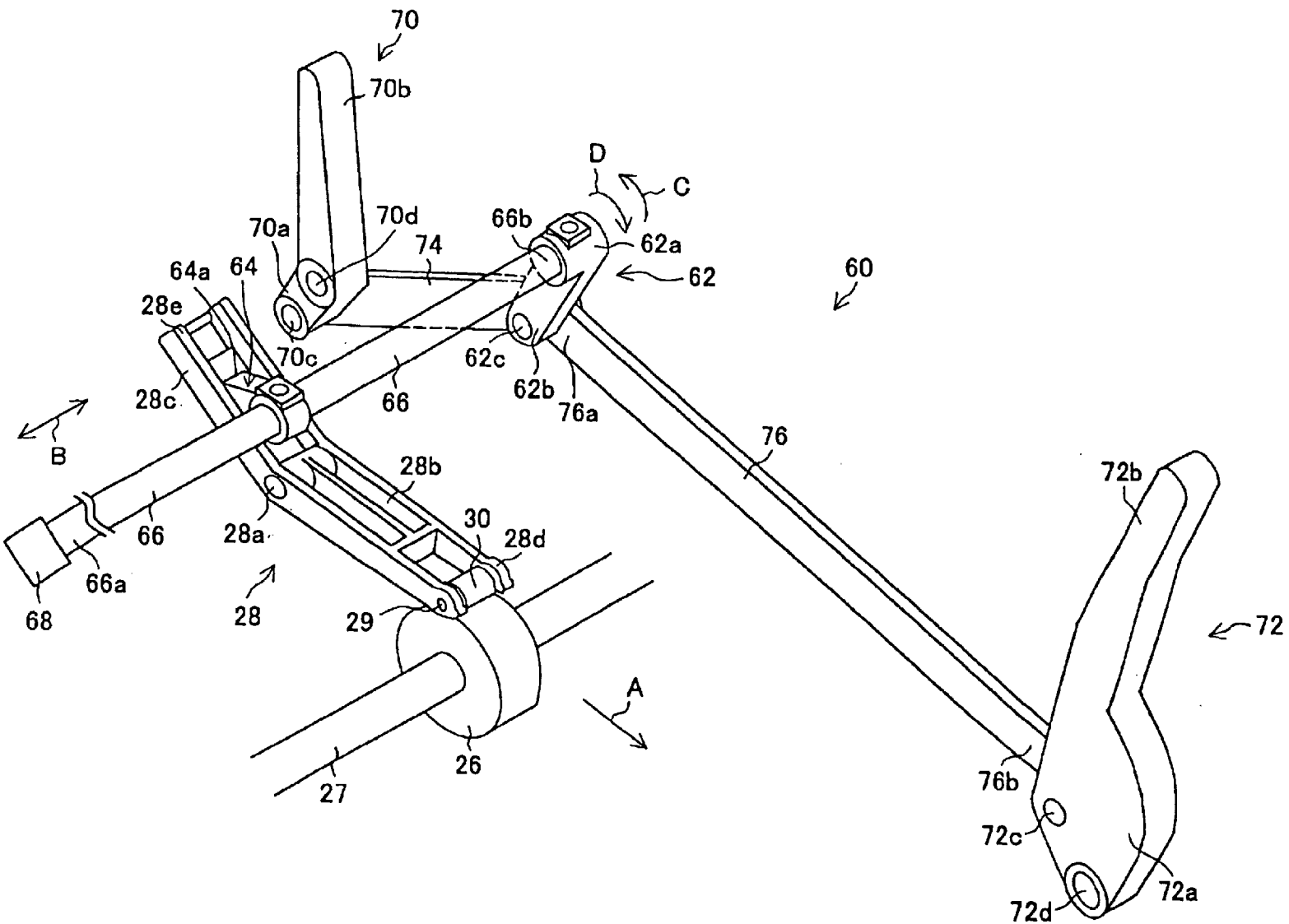
FIG. 5 is an enlarged perspective view of a coupling unit and related parts incorporated in the plotter shown in FIG. 4.

Similarly, when the second lever 72 instead of the first lever 70 is pushed down from the coupling position to the decoupling position, the second arm 76 is pulled by the second lever 72 in the arrow A direction to turn the turning arm 62 clockwise in FIG. 4 (arrow C direction in FIG. 5). This turning movement pulls the first arm 74 in the arrow A direction to turn the first lever 70 clockwise in FIG. 4 around the turning shaft 70*d* to the decoupling position.

The turn of the first lever 70 (or the second lever 72) as described above from the coupling position to the decoupling position allows the turning shaft 66 to turn in the turning direction of the turning arm 62. Thereby, the pushing cam 64 pushes down the upstream-side arm 28*c* to raise the downstream-side arm 28*b* to lift the driven roller 30 above the driving roller 26. Therefore, in exchange of the rolled paper sheet or a like operation, the front end portion of the fresh rolled paper sheet can be introduced (inserted) through the inlet port 16 into the gap between the driven roller 30 and the driving roller 26.

For pinching the fresh rolled paper sheet 20 between the driven roller 30 and the driving roller 26, the first lever 70 (or the second lever 72) is turned from the decoupling position to the coupling position. Reverse to the above decoupling operation, by this operation, the pulling coil spring 100 pulls up the upstream-side arm 28*c* to lower the downstream-side arm 28*b*. Thereby, the driven roller 30 presses the driving roller 26 through the rolled paper sheet 20 to pinch the rolled paper sheet 20 between the driven roller 30 and the driving roller 26. In this state, the first lever 70 and the second lever 72 are respectively at the coupling position.

As described above, the driven roller 30 and the driving roller 26 are coupled and decoupled by handling only the first lever 70 placed at the side of the inlet port 16. Therefore, the user can conduct all of the operation of exchange of the rolled paper sheet 20 on the side of the inlet port 16.

The openable cover 13 is fixed at one end 13*b* thereof to be turnable around the turning shaft 13*a* center. With the second lever 72 at the coupling position, the other end 13*c* opposite to the end 13*b* of the openable cover 13, when it is closed, is at a lower position than the end 72*b* of the second lever 72 in the downstream side in the arrow A direction. Thereby, if the user tries to move the second lever 72 for decoupling, the tip end 72 of the second lever 72 will collide against the end 13*c*. Thus the second lever 72 at the coupling position is locked not to be moved to the decoupling position. The first lever 70, which is linked to the second lever 72 through the coupling unit 60, is also locked together with the second lever.

Normally, the openable cover 13 is closed during image formation with the plotter 10. Therefore, during the image formation with the plotter 10, the first lever 70 and the second lever 72 are both protected from misoperation, which ensures precise delivery of the rolled paper sheet 20 without causing decoupling of the driven roller 30 from the driving roller 26. Therefore, the image formation is not interrupted by failure of delivery of the rolled paper sheet 20.

The plotter of a second embodiment of the image formation apparatus of the present invention is explained by reference to FIG. 6.

Figure 6:
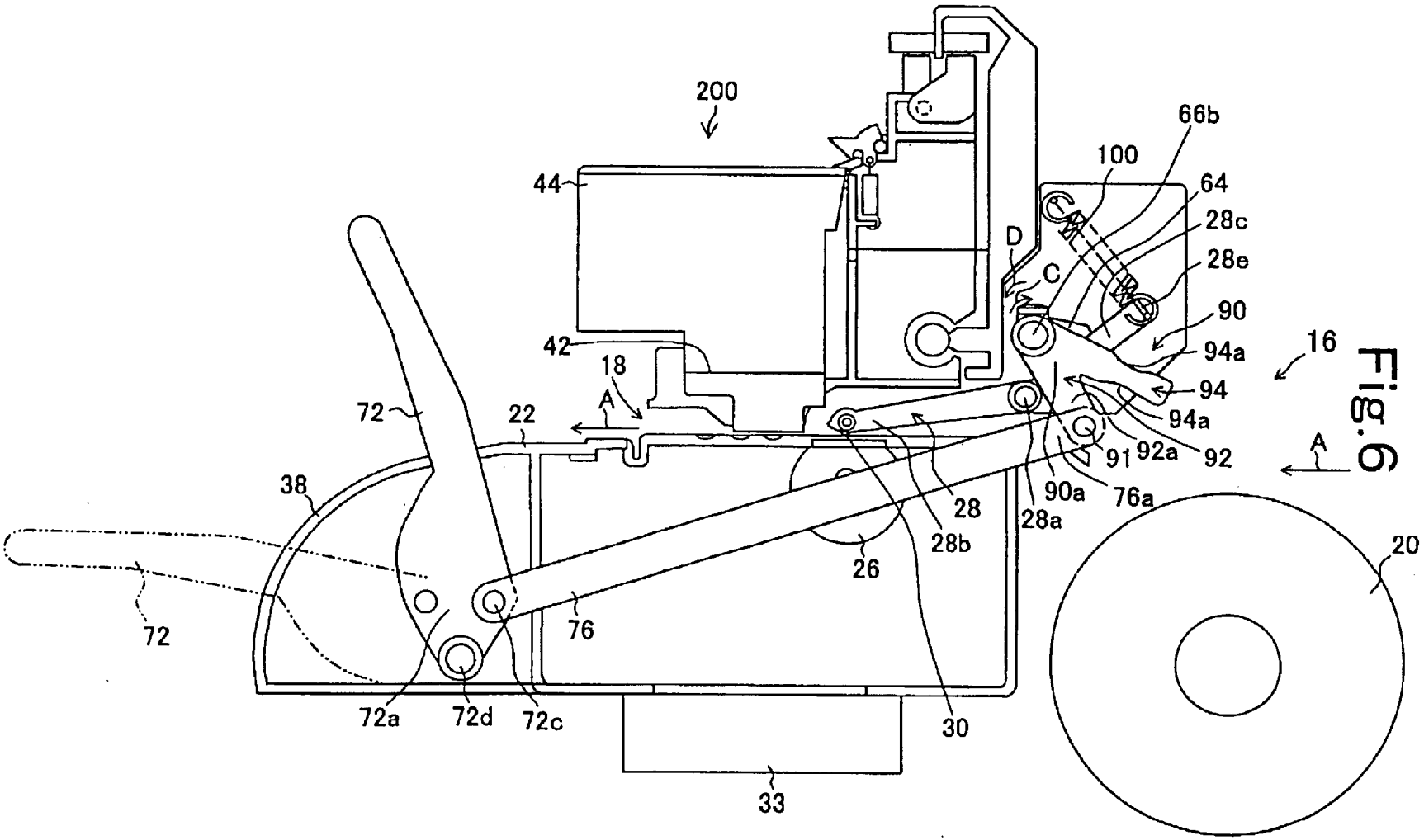
FIG. 6 is a side view showing the inside structure of a plotter of a second embodiment of the present invention.

FIG. 6 is a side view showing the inside structure of a plotter of the second embodiment of the present invention. In FIG. 6, the same symbols are used as in FIG. 4 for indicating corresponding constitutional elements. The general constitution of the plotter 200 of the second embodiment is nearly the same as the plotter 10 of the first embodiment shown in FIGS. 1–3. The plotter 200 of the second embodiment is different from the plotter 10 in that the plotter 200 of the second embodiment has a turning arm lever 90 which is constituted of a turning arm 92 corresponding to the turning arm 62 and a plate-shaped third lever 94 (an example of a third manipulating member) formed in one body, instead of combination of the first lever 70, the first arm 74, and the turning arm 62 (FIG. 4) of the plotter 10. In description of the constitutional elements of the plotter 200, FIG. 5 is suitably referred to for the parts corresponding to the parts of the plotter 10.

In the plotter 200, the turning arm 92 and the third lever 94 are formed in integration into a V-shaped turning arm lever 90. This turning arm lever 90 is placed near the inlet port 16. The connecting end portion 90*a* of the turning arm lever 90 is connected to a second end portion 66*b* of the turning shaft 66 perpendicularly to the length direction of the turning shaft 66 to be turnable freely around the turning shaft 66.

The turning arm 92 extends downward from the connecting end portion 90*a*. The third lever 94 also extends from the connecting end portion 90*a*. This third lever 94 extends straight downward in the upstream direction against the sheet delivery direction before the turning arm 92. Thus, the turning arm lever 90 is connected to the second end 66*b* in a shape of a reversed V-letter. The turning shaft 66 is turned by the turning arm lever 90 in the same direction by the same angle as the turning arm lever 90.

An end portion 76*a* of a second arm 76 is connected to the lower end portion 92*a* of the turning arm 92 by a pin 91 to be turnable. The second lever 72 is linked to the turning arm 92 through the second arm 76.

The third lever 94 has a slightly concaved grip portion 94*a* for easy gripping by the user in manipulation of the lever. This third lever 94 serves as a manipulating lever for turning the turning arm 92. Therefore in the plotter 200, the turning arm 92 is turned by manipulation of the third lever 94 or the second lever 72.

In FIG. 6, the turning arm 92 can be turned in the arrow-C direction (prescribed direction) and the turning shaft 66 also can be turned thereby in the arrow-C direction by pushing down the second lever 72 from the coupling position shown by the solid line to the decoupling position shown by the two-dot chain line or by manipulating the third lever 94 in the arrow-C direction. Thereby the pushing cam 64 fixed to the turning shaft 66 is turned in the arrow-C direction. Thus, the pushing cam 64 pushes down the upstream-side arm 28*c* of the driven-roller arm 28 to lift the downstream-side arm 28*b*. Consequently, driven roller 30 is separated upward from the driving roller 26.

When the driven roller 30 is apart from the driving roller 26, the rolled paper sheet 20 introduced from the inlet port 16 can be inserted between the driven roller 30 and the driving roller 26. By turning the second lever 72 from the decoupling position to the coupling position or by turning the third lever 94 in the direction opposite to the arrow-C direction (arrow-D direction), the pushing cam 64 is turned in the arrow-D direction by the turning shaft 66. Thereby, the upstream-side arm 28*c* is released from the pushing pressure of the pushing cam 64, and is pulled up by the pulling coil spring 100. Thus the downstream-side arm 28*d* is lowered to allow the driven roller 30 to press the driving roller through the rolled paper sheet 20. Thereby, the rolled paper sheet 20 inserted between the driven roller 26 and the driving roller 30 is pinched by the driving roller 26 and the driven roller 30 by operation only on the side of the inlet port 16.

With the plotter 200, since the turning arm lever 90 can be turned by manipulating the third lever 94, another manipulating member need not be connected to the turning arm 92 in the side of the inlet port 16. This simplifies the plotter structure in comparison with the plotter having a manipulating member connected to the turning arm 92.

A third embodiment of the image-forming apparatus of the present invention is described by reference to FIGS. 7–10.

Figure 7:
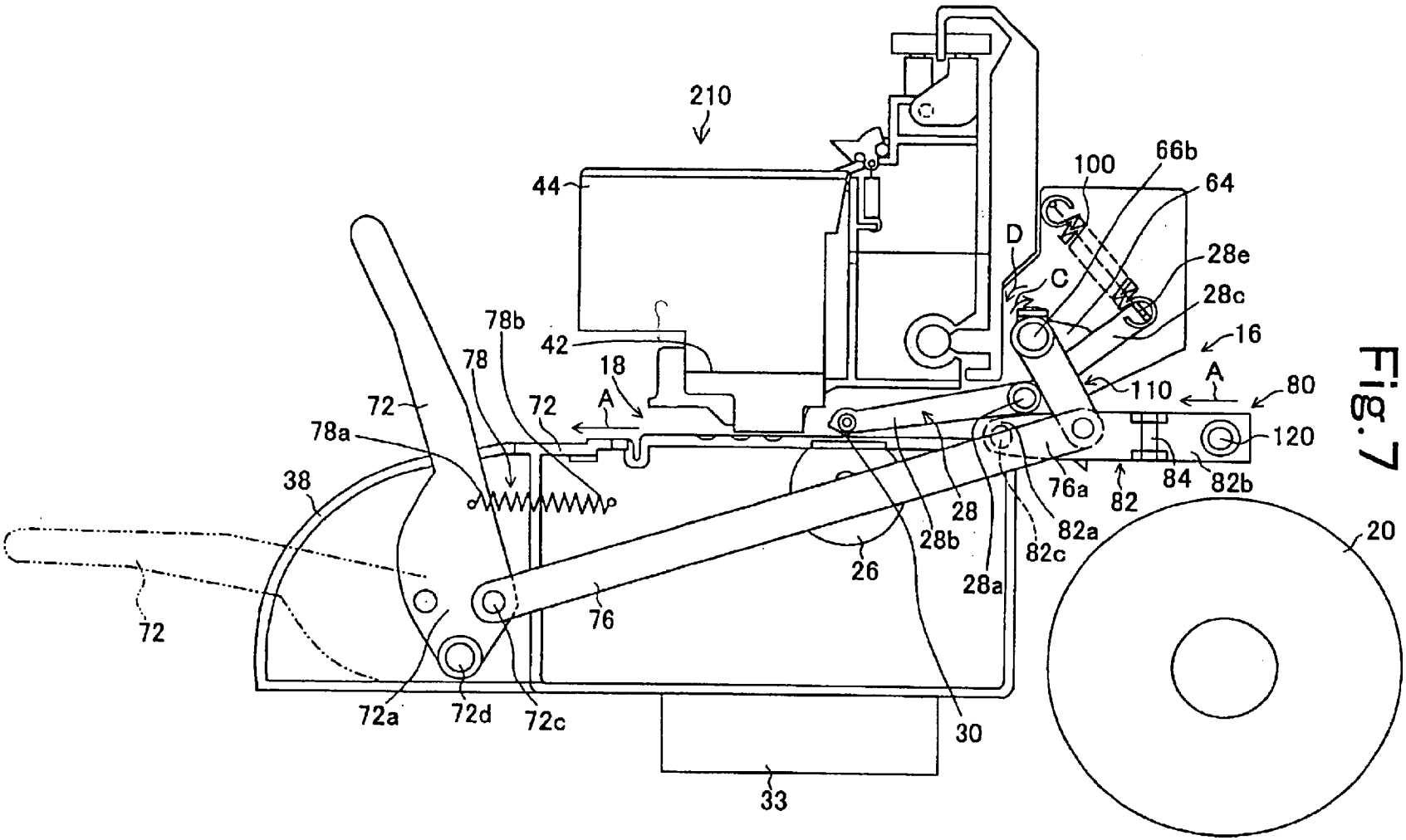
FIG. 7 is a side view showing the inside structure of a plotter of a third embodiment of the present invention.
Figure 8:
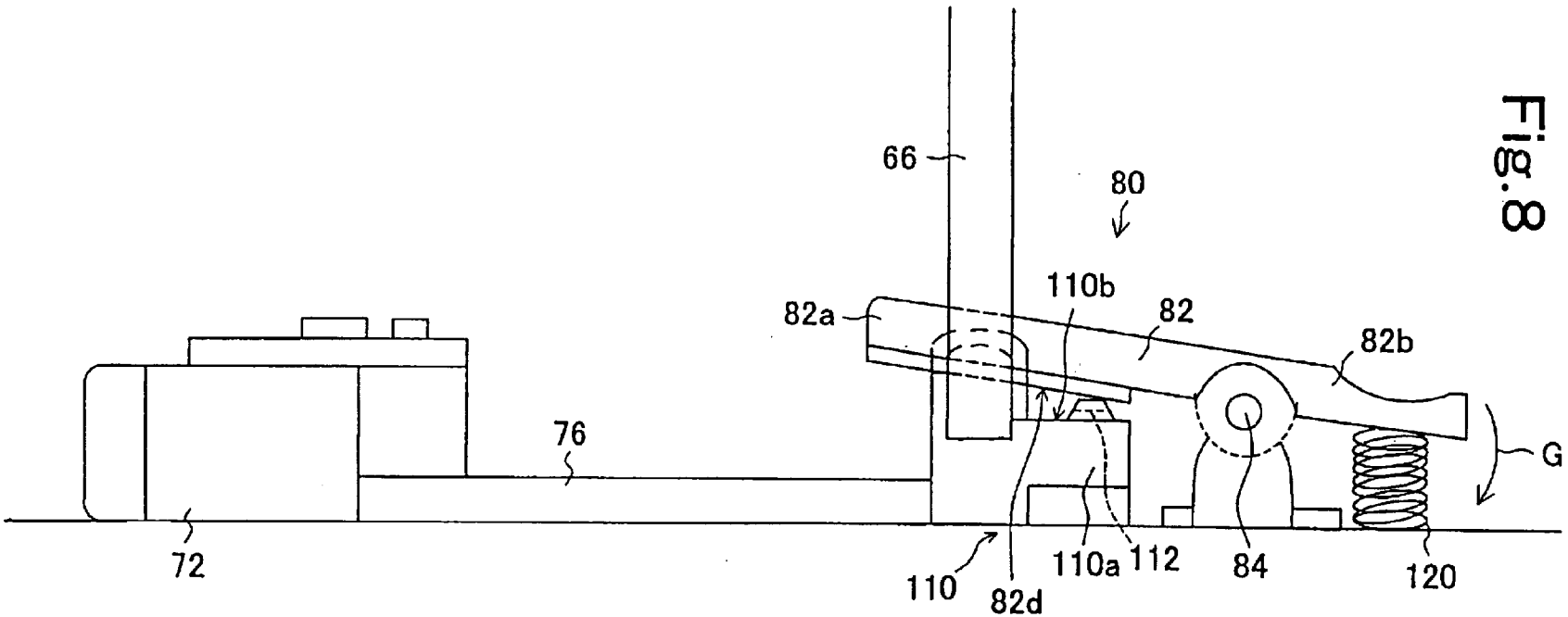
FIG. 8 is a plan view illustrating a state of the turning arm of the plotter disengaged from the stopper of FIG. 7.
Figure 9:
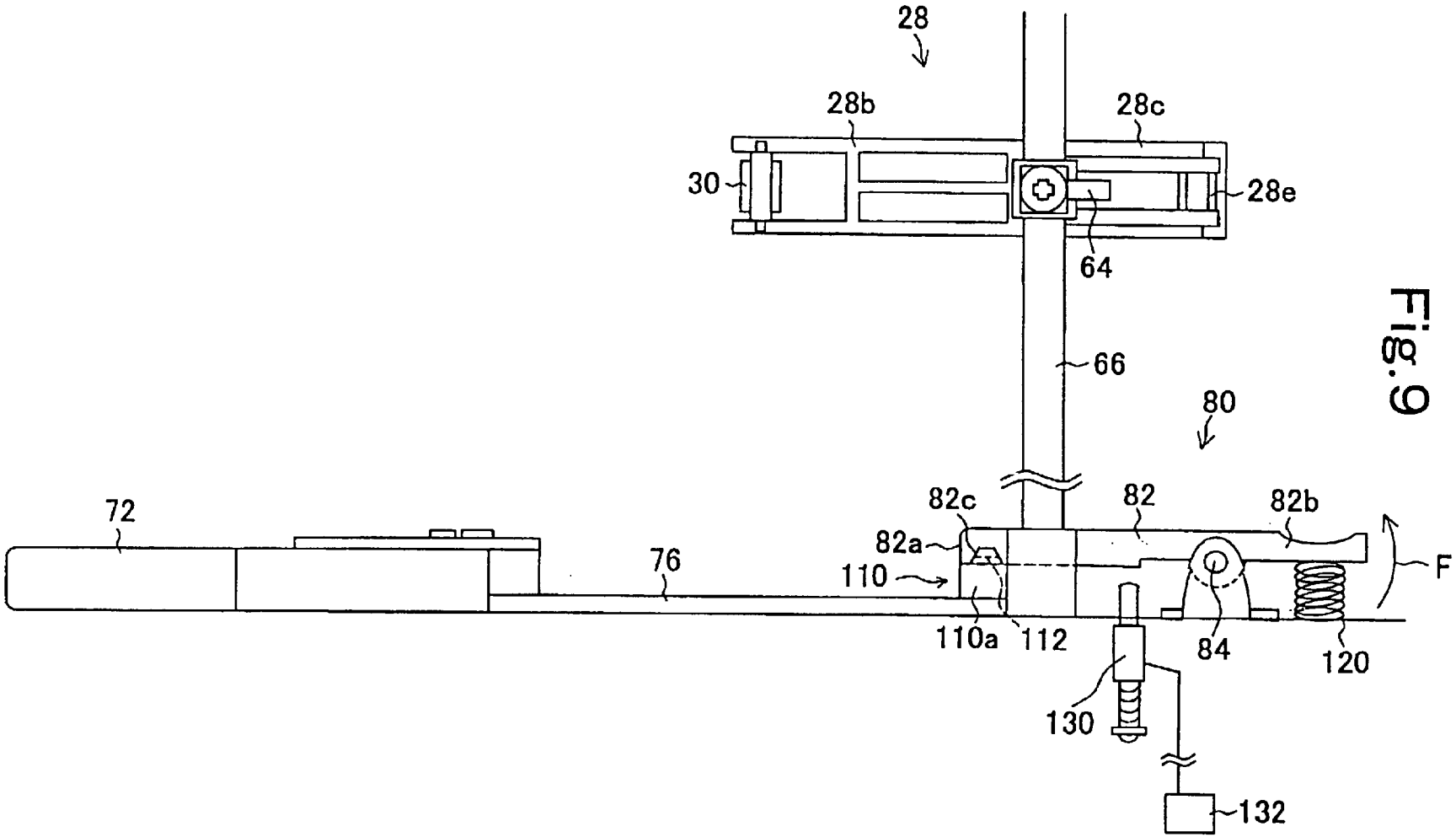
FIG. 9 is a plan view illustrating a state of the turning arm engaged to the stopper.
Figure 10:
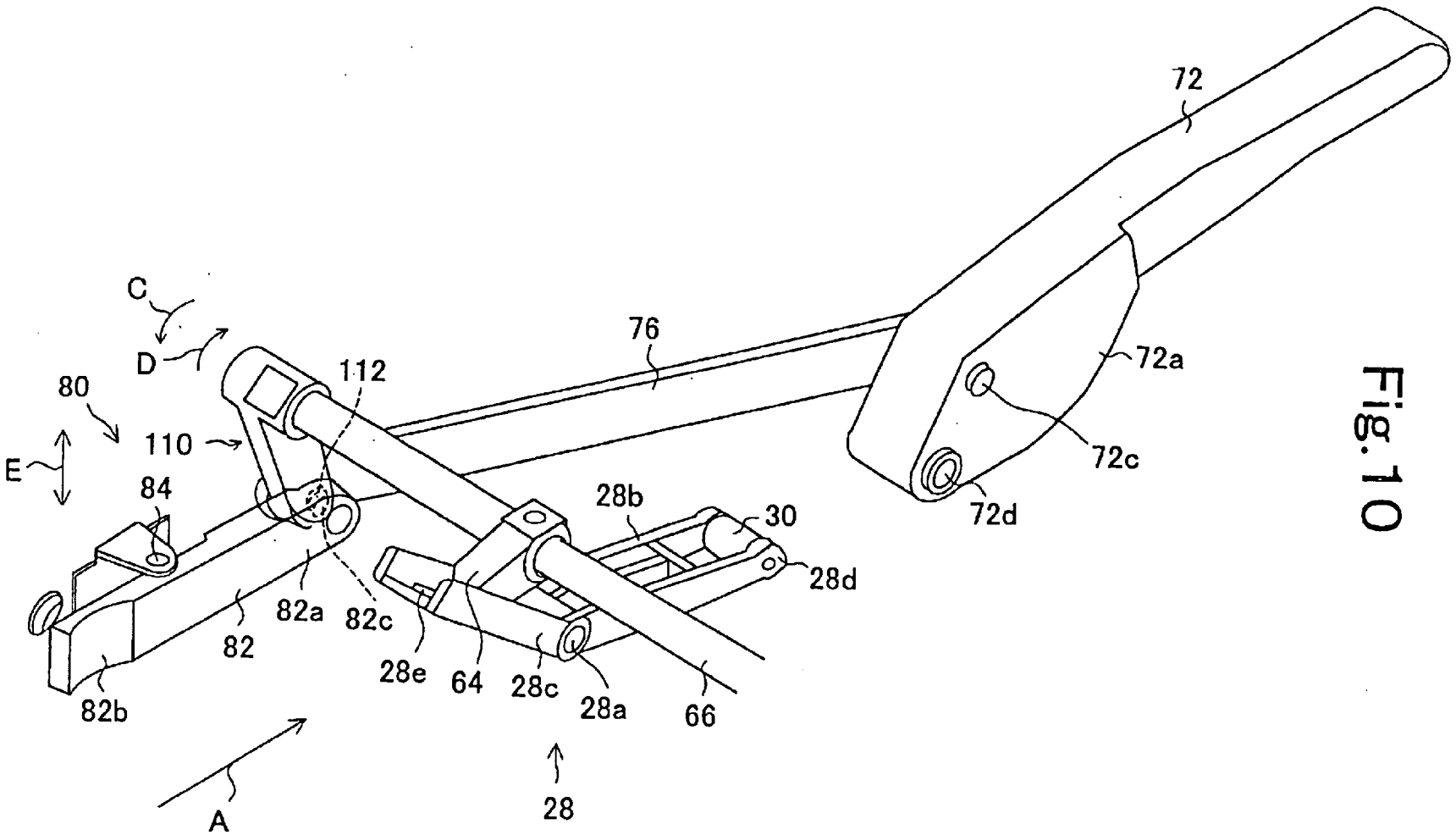
FIG. 10 an enlarged perspective view of the driven roller and the stopper with the second lever set at the decoupling position.

FIG. 7 is a side view showing the inside structure of a plotter of the third embodiment of the present invention. FIG. 8 is an enlarged plan view of the turning arm and the stopper of the plotter of FIG. 7 in a disengaged state. FIG. 9 is an enlarged plan view illustrating the turning arm and the stopper in an engaged state. FIG. 10 an enlarged perspective view of the driven roller and the stopper with the second lever set at the decoupling position. In these drawings, the same symbols are used for indicating the corresponding constitutional elements as shown in FIGS. 4–6. The general constitution of the plotter 210 of the third embodiment is nearly the same as that of the plotter 10 of the first embodiment shown in FIGS. 1–3.

The plotter 210 of the third embodiment comprises neither the first lever 70 nor the first arm 74 which are employed in the plotter 10 of the first embodiment, and comprises no turning arm lever 90 which is employed in the plotter 200 of the second embodiment. The turning arm 110 of the plotter 210 has a protrusion 112 described later, which is different from the turning arm 62 of the first embodiment and the turning arm 92 of the second embodiment. Further, differently from the plotter 10 and plotter 200, the plotter 210 has a stopper 80 (an example of a first locking means in the present invention) near the inlet port 16 for stopping the turning arm 110 not to be turned by a force weaker than a prescribed strength in the arrow-C direction (prescribed direction), and has a pulling coil spring 78 to pull the second lever 72 in the upstream side against the sheet delivery direction.

The pulling coil spring 78, which is a feature of the plotter 210 of the third embodiment, is fixed at one end 78*a* to the second lever 72. The other end 78*b* opposite to the end 78*a* is fixed to the main body of the plotter 210 at an upstream side of the end 78*a* against the sheet delivery direction. The position of fixation of the end 78*a* is above the position of the pin 72*c* connecting the second arm 76 to the second lever 72. When the second lever 72 is forced only by the pulling coil spring 78, the second lever 72 is held by the pulling coil spring 78 at the coupling position as shown by a solid line in FIG. 7. Therefore, the second lever is at the coupling position, provided that the second lever 72 is not caught by the stopper 80 explained below.

The stopper 80, which is another feature of the plotter 210, has an engaging arm 82 in a narrow plate shape extending in the sheet delivery direction (arrow-A direction). The side face 82*d* (FIG. 8) of the engaging arm 82 is placed in parallel to the side face 110*b* of the turning arm 110.

The front end 82*a* of the engaging arm 82 is placed at the downstream side of the turning shaft 66 along the sheet delivery direction near the turning arm 110. The rear end 82*b* opposite to the front end 82*a* of the engaging arm 82 is placed at the upstream side of the turning shaft 66 against the sheet delivery direction. This rear end 82*b* is fixed to the turning shaft 84 to be turnable around the turning shaft 84 extending in the direction perpendicular to the arrow-A direction (arrow-E direction in FIG. 10).

When the second lever 72 is brought to the position shown by a two-dot chain line in FIG. 7, the lower end 110*a* of the turning arm 110 and the front portion 82*a* of the engaging arm 82 are crossing as viewed from the length direction of the turning shaft 66. A hollow 82*c* (FIG. 9) is formed at the part of the front portion to which the bottom portion 110*a* faces when the second lever 72 is at the decoupling position. At the part of the lower end 110*a* facing the hollow 82*c*, a protrusion 112 is formed which protrudes toward the hollow 82*c*, the protrusion being in a shape to fit to the hollow 82*c*.

The rear portion 82*b* is energized by a compression spring 120 in the direction F (counterclockwise in FIG. 9) so as to engage the hollow 82*c* of the front portion 82*a* with the protrusion 112. Therefore, the protrusion 112 is engaged with the hollow 82*c* when the turning arm 110 is turned to allow the protrusion 112 to face the hollow 82*c*. The turning arm 110 is locked by the engagement of the protrusion 112 with the hollow 82*c* not to turn in the arrow-C direction (a prescribed direction) by a force weaker than a prescribed strength.

In the plotter 210 having the constitution described above, the protrusion 112 of the turning arm 110 is allowed to engage with the hollow 82*c* of the stopper 80 placed near the inlet port 16 by turning the turning shaft 66 in the arrow C direction (prescribed direction) in FIG. 10 by pushing down the second lever 72 to the decoupling position. Thereby the stopper 80 hooks the turning arm 110 not to turn, and the pushing cam 64 keeps pushing the upstream-side arm 28*c* of the driven roller arm 28 to retain the driven roller 30 above the driving roller 26. In this state, the rolled paper sheet 20 introduced through the inlet port 16 can readily be inserted between the driven roller 30 and the driving roller 26.

The stopper 80 can be released from the turning arm 110 by pushing the rear portion 82*b* of the stopper 80 to the direction for disengaging the hollow 82*c* from the protrusion 112 (arrow-G direction in FIG. 8) against the compression coil spring 120. Thereby the second lever 72, which is being pulled by the pulling coil spring 78, is allowed to return from the decoupling position to the coupling position. The turning arm 110, which is linked through the second arm 76 to the second lever 72, can be moved in the arrow-D direction reverse to the arrow C direction by the returning movement of the second lever 72 to the coupling position. When the second lever 72 is at the coupling position, the engaging arm 82 is being pushed up from the protrusion 112, and the turning arm 110 can be turned in the arrow-C direction. When the second lever 72 is at the decoupling position, the engaging arm 82 can be pushed up by applying a force stronger than a prescribed strength to the second lever 72 in the arrow-C direction (prescribed direction) along the side face of the protrusion 112 above the protrusion 112, and the turning arm 110 can be turned in the arrow-C direction (prescribed direction).

This turning movement of the turning arm 110 allows the turning shaft 66 to turn in the arrow-D direction to release the pressure of the pushing cam 64 applied onto the upstream-side arm 28*c*. Thereby, the downstream-side arm 28*b* is lowered to allow the driven roller 30 to press the driving roller 26 through the rolled paper sheet 20. Thus, the rolled paper sheet 20 comes to be pinched between the driven roller 30 and the driving roller 26 when the stopper 80 is disengaged from the turning arm 110 with the rolled paper sheet 20 being inserted between the driven roller 30 and the driving roller 26.

As described above, in the plotter 210, the rolled paper sheet 20 inserted between the driven roller 30 and the driving roller 26 can be pinched between the driven roller 30 and the driving roller 26 by manipulating only the stopper 80 placed near the inlet port 16. Therefore, the rolled paper sheet 20 can be pinched between the driving roller 26 and the driven roller 30 by operation either at the inlet port side or at the outlet port side.

For disengaging the protrusion 112 from the hollow 82*c* by pushing the engaging arm 82 to turn in arrow-G direction, a solenoid 130 (an example of the stopper-releasing member) may be provided near the stopper 80. To the solenoid 130, a solenoid control unit 132 (an example of the releasing device controller in the present invention) may be connected.

By actuation of the solenoid 130 by manipulating the solenoid control unit 132, the stopper 80 can be disengaged from the turning arm 110. Thereby, the turning arm 110 is turned in the arrow D direction to release the pressure of the pushing cam 64 onto the upstream-side arm 28*c*. Thereby, the rolled paper sheet 20 placed between the driven roller 30 and the driving roller 26 is pinched between the driven roller 30 and the driving roller 26.

The solenoid control unit 132 may be incorporated into the control unit 14 of the plotter 210 (FIG. 1), or may be placed in another position without limitation in the placement. Therefore the solenoid controller 132 may be placed at a convenient position for the decoupling-coupling of the driven roller 30 and the driving roller 26 for exchange of the rolled paper sheet 20 or a like operation.

INDUSTRIAL APPLICABILITY

According to the first embodiment of the image-forming apparatus of the present invention, a described above, a pair of rollers can be coupled and decoupled by handling a first manipulating member placed near the inlet port. With this manipulating member, the user, standing on the inlet port side, can decouple the pair of rollers, and insert a recording sheet through the inlet port between the pair of rollers. The recording sheet can be pinched and fixed by the pair of rollers by handling the first manipulating member to bring the pair of rollers into pressure-contact with each other. In such a manner, the operation of inserting the recording sheet through the inlet port between the pair of rollers and pinching and fixing the recording sheet for delivery can be conducted from only the inlet port side. Thereby, the image-forming apparatus is improved in the operability.

Further, the image-forming apparatus may be equipped with a second manipulating member placed near the outlet port and linked to the coupling unit for manipulating the coupling unit. In this case, the pair of rollers can be coupled or decoupled by manipulating the coupling unit either by the first manipulating member placed near the inlet port or by the second manipulating member placed near the outlet port. Therefore, the user can decouple the pair of rollers and insert the recording sheet through the inlet port between the by manipulating either the first manipulating member or the second manipulating member. The recording sheet can be pinched by bringing the pair of rollers into pressure-contact with each other. Therefore, the operation of pinching the recording sheet inserted through the inlet port between the pair of rollers for sheet delivery can be conducted either on the inlet port side or the outlet port side. Therefore, the image-forming apparatus can be improved further in its operability.

The coupling unit may comprise a turning arm which is connected to both of the first manipulating member and the second manipulating member to be turnable in a prescribed direction and the reverse direction, and a coupling member which is linked to the turning arm which decouples the pair of rollers with turn of the turning arm in the prescribed direction and brings the pair of rollers into pressure-contact with each other with turn of the turning arm in the reverse direction. In this case, the pair of rollers can be decoupled by the coupling member linked to the turning arm which is turnable in the prescribed direction with the turning arm, whereby the recording sheet can be inserted through the inlet port into the gap between the pair of the decoupled rollers. This recording sheet can be pinched between the pair of rollers by turning the first or second manipulating member in the reverse direction. By this turn in the reverse direction, the recording sheet is pinched between the pressure-contacted rollers. In such a manner, the recording sheet which has been inserted through the inlet port and pinched between the pair of rollers is made ready for sheet delivery. Thus the image-forming apparatus is improved in its operability. The coupling unit, which is constituted of a turning arm linked to the first and second coupling members and a coupling member linked to the turning arm, has a simple structure.

The image-forming apparatus may be equipped with a third manipulating member formed in integration with the turning arm instead of the first manipulating member, placed near the inlet port. In this apparatus, turn of the third manipulating member in the prescribed direction turns the turning arm combinedly in the prescribed direction to decouple the pair of rollers, and turn of the third manipulating member in the reversed direction turns the turning arm also in the reverse direction to bring the pair of rollers into pressure-contact with each other to be ready for delivery of the recording sheet pinched between the pair of rollers. The third manipulating member, which is formed in integration with the turning arm, ensure the turn of the turning arm by handling of the third manipulating member. Thereby the operability is improved more. The integration of the third manipulating member and the turning arm reduces the number of the parts and simplifies the structure to decrease the causes of the apparatus failure.

According to the second embodiment of the image-forming apparatus of the present invention, the manipulating member is energized to take the position for the coupling, so that a force is applied to restore the manipulating member from the decoupling position to the coupling position. However, the manipulating member at the decoupling position is locked by a first locking means placed near the inlet port to prevent the turn of the turning arm. Thereby, the coupling member linked to the turning arm keeps the pair of, rollers decoupled. This enables insertion of the recording sheet through the inlet port into the gap between the pair of rollers. When the turning arm is released from the locking by the first locking means, the manipulating member energized to return to the coupling position is restored from the decoupling position to the coupling position. Thereby the turning arm is released from the first locking member to be turnable. The return of the manipulating member to the coupling position turns the turning arm to allow the coupling member linked to the turning arm to bring the pair of rollers into pressure contact with each other, and the pair of rollers to pinch the recording sheet. In such a manner, the first locking means placed near the inlet port locks the turning arm to keep the pair of rollers to be decoupled, enabling insertion of the recording sheet through the inlet port. On the other hand, when the turning arm is released from the locking by the first locking means, the pair of rollers is allowed to come into pressure contact with each other to pinch the recording sheet. The recording sheet inserted through the inlet port can be pinched between the pair of rollers and is made ready of delivery by operation from only the inlet port side. Thus the image-formation apparatus is improved in its operability.

The image-forming apparatus may comprise a releasing means which is placed near the inlet port and releases the turning arm from the locking by the first locking means. When the turning arm is released by the releasing means from the first locking means, the manipulating member energized to return to the coupling position is returned from the decoupling position to the coupling position by an energizing means. Thereby the turning arm is turned by the operating member returning to the coupling position to couple the pair of rollers, and the pair of rollers pinches the recording sheet. As described above, locking of the turning arm by the first locking means keeps the pair of rollers decoupled, enabling insertion of the recording sheet through the inlet port, whereas release of the turning arm from the first locking means couples the pair of rollers to pinch the recording sheet by the pair of rollers. Therefore, the recording sheet inserted through the inlet port can be pinched between the pair of rollers to be ready of delivery by operation from only the inlet port side. Thus the image-formation apparatus is improved in its operability.

According to the third embodiment of the image-forming apparatus of the present invention, a pair of rollers can be decoupled by moving a turning arm in a prescribed direction by handling either a first manipulating member placed near an inlet port or a second manipulating member placed near an outlet port for insertion of a recording sheet between the pair of rollers. To pinch the recording sheet between the pair of rollers, the first or second manipulating member is handled to move the turning arm in the direction reverse to the above prescribed direction. This turn in the reverse direction couples the pair of rollers to pinch the recording sheet. Thus the recording sheet inserted through the inlet port can be pinched between the pair of rollers by handling only the first manipulating member near the insert port by the operation only at the insert port side. Thus the image-forming apparatus is improved in operability. Since the turning arm interlocks the first manipulating member and the second manipulating member, locking of either one of the first and second manipulating members by the second locking means will lock simultaneously both of the first and second manipulating members not to be movable. Thereby neither the first and second manipulating member is not erroneously operated. Consequently, the pair of rollers are surely coupled without interruption of the delivery of the recording sheet.

The second locking means herein is an openable cover which can be opened upward to uncover the main body of the apparatus. This openable cover which is in a closing position can prevent turn of the first or second manipulating member. With the pair of rollers coupled and pinching the recording sheet, the cover in the closing position locks the first or second manipulating member not to turn. Since the first and second manipulating members are interlocked, the locking of one manipulating member locks the other. Normally, during the image formation with the image-forming apparatus, the openable cover is closed, so that the first and second manipulating members can not be erroneously operated. Consequently, the pair of rollers are surely coupled without interruption of delivery of the recording sheet.

The fourth embodiment of the image-forming apparatus of the present invention comprises a turning arm lever having a third lever extending to the vicinity of the inlet port. This turning arm lever is linked through a second arm to a second manipulating member. Therefore, the turning arm can be turned by manipulating the second manipulating member or the third lever. The turning shaft to which the end of the turning arm is connected is supported at one end by a bearing to be turnable in accordance with the turn of the turning arm lever. The turning shaft turned in a prescribed direction allows a pushing cam fixed to the turning shaft to push a driven roller arm to lift the driven roller above the driving roller. With the driven roller decoupled from the driving roller, the recording sheet introduced through the inlet port can be inserted between the driven roller and the driving roller. By turning the turning shaft in the reverse direction by handling the second manipulating member or the third lever extending toward the inlet port, the driven roller is coupled to the driving roller. Therefore, the recording sheet introduced from the inlet port can be pinched and delivered by the driven roller and the driving roller by operation only at the inlet port side. Thus the image-forming apparatus is improved in operability. In this embodiment, since the third lever enables turning of the turning arm lever, an additional manipulating member like a second manipulating member need not be connected at the inlet port side. Thereby the apparatus has a construction simpler than the ones having an additional manipulating member, and the causes of the apparatus failure is decreased.

In the fifth embodiment of the image-forming apparatus of the present invention, when the turning shaft is turned in a prescribed direction, a stopper placed near inlet port catches a protrusion of the turning arm to lock the turning arm not to turn. Thereby, a pushing cam keeps pushing the arm of the driven roller arm, holding the driven roller above the driving roller to facilitate insertion of the recording sheet through the inlet port. After insertion of the recording sheet between the driven roller and the driving roller, the protrusion caught is released from the stopper, whereby-the second manipulating member is pulled by a pulling coil spring upstream against the delivery direction. The second manipulating member, which is linked through the second arm to the turning arm, is turned in the direction reverse to the prescribed direction with the second manipulating member pulled upstream against the delivery direction. The turning shaft, which is connected to the upper end of the turning arm and is supported in a turnable manner by a bearing at the end, is turned with the turn of the turning arm. Thereby, the turning shaft is turned in the direction reverse to the prescribed direction to couple the driven roller with the driving roller to pinch the recording sheet between the driven roller and the driving roller. As described above, only by handling the stopper near the inlet port, the recording sheet can be pinched and delivered between the driving roller and the driven roller. Accordingly, in this embodiment, the recording sheet can be pinched and delivered between the driving roller and the driven roller by operation only at the inlet port side. Thus the image-forming apparatus is improved in operability.

In the image-forming apparatus which is provided with a stopper-releasing device for releasing the protrusion from the stopper and a release controller for controlling the release controller, the stopper is disengage from the protrusion by operating the release controller to actuate the stopper-releasing device. Thereby, the turning arm is turned in the direction reverse to the prescribed direction to couple the driven roller and the driving roller. Thus the recording sheet inserted between the driving roller and the driving roller is pinched by the driven roller and the driving roller. The placement of the release controller can be selected with high freedom, so that the release controller can be placed at a convenient position. Thereby the image-forming apparatus can be improved further in operability.

What is claimed is:

1. An image-forming apparatus having a pair of rollers for pinching and delivering a recording sheet in a delivery direction toward an image-forming zone for image formation, the recording sheet being introduced from an inlet port placed at an upstream side of the pair of rollers against the delivery direction and being discharged from an outlet port placed at a downstream side of the image-forming zone along the delivery direction:

said image-forming apparatus comprising a coupling unit for coupling and decoupling the pair of rollers;

a first manipulating member placed near the inlet port, and linked to the coupling unit for manipulating the coupling unit;

a second manipulating member placed near the outlet port, and linked to the coupling unit for manipulating the coupling unit;

and the coupling unit comprising a turning arm linked to both of the first manipulating member and the second manipulating member and being turnable in a prescribed direction and the reverse direction, and a coupling member linked to the turning arm for decoupling the pair of rollers by turning the turning arm in the prescribed direction and coupling the pair of rollers by turning the turning arm in the reverse direction.

2. The image-forming apparatus according to claim 1, which comprises a third manipulating member, instead of the first manipulating member, formed in integration with the turning arm, and placed near the inlet port.

3. An image-forming apparatus having a pair of coupleable rollers for pinching and delivering a recording sheet in a delivery direction toward an image-forming zone for image formation, the recording sheet being introduced from an inlet port placed at an upstream side of the pair of rollers against the delivery direction and being discharged from an outlet port placed at a downstream side of the image-forming zone along the delivery direction:

said image-forming apparatus comprising a first manipulating member placed near the inlet port for coupling and decoupling the pair of rollers;

a second manipulating member placed near the outlet port for coupling and decoupling the pair of rollers;

a turning arm linked to both of the first manipulating member and the second manipulating member and being turnable in a prescribed direction and the reverse direction;

a coupling member linked to the turning arm, for decoupling the pair of rollers by turning the turning arm in the prescribed direction and coupling the pair of rollers by turning the turning arm in the reverse direction;

a locking means for locking one of the first manipulating member and the second manipulating member when the pair of rollers are coupled.

4. The image-forming apparatus according to claim 3, wherein a locking means is an openable cover which is openable at an upper part of the main body of the image-forming apparatus, and the openable cover prevents turn of the first manipulating member or the second manipulating member to lock the manipulating means when the openable cover is closed.

5. An image-forming apparatus having a driving roller for delivering a recording sheet in a delivery direction toward an image formation zone, a turnable arm extending in a direction nearly parallel to the delivery direction above the driving roller, and a driven roller fixed rotatably to the turnable arm and capable of coupling with the driving roller, the recording sheet being introduced from an inlet port placed at an upstream side of the driving roller against the delivery direction and being discharged from an outlet port placed at a downstream side of the image-forming zone along the delivery direction, said image-forming apparatus comprising a turnable shaft extending in a direction crossing the turnable arm above the driven roller;

a bearing for supporting one end of the turnable shaft;

a pushing cam which pushes the turnable arm with turn of the turning shaft in the prescribed direction to lift the driven roller above the driving roller, and couples the driven roller with the driving roller with turn of the turning shaft in the direction reverse to the prescribed direction;

a turning arm lever having a connecting end connected to the other end of the turning shaft, a turning arm extending downward from the connecting end in a direction approximately perpendicular to the turning shaft, and a third lever extending from the connecting end to vicinity of the inlet port at the upstream side against the delivery direction;

a second arm having a first end connected to a bottom end of the turning arm, and a second end placed at the position downstream after the first end along the delivery direction; and a second manipulating member having a turning end fixed in a turnable manner near the outlet port and connected to the second arm at the second end.

6. An image-forming apparatus having a driving roller for delivering a recording sheet in a delivery direction toward an image formation zone, a turnable arm extending in a direction nearly parallel to the delivery direction above the driving roller, and a driven roller fixed rotatably to the arm and capable of coupling with the driving roller, the recording sheet being introduced from an inlet port placed at an upstream side of the driving roller against the delivery direction and being discharged from an outlet port placed at a downstream side of the image-forming zone along the delivery direction:

said image-forming apparatus comprising a turnable shaft extending in a direction crossing the turnable arm above the driven roller;

a bearing for supporting one end of the turnable shaft;

a pushing cam which pushes the arm with turn of the turning shaft in the prescribed direction to separate the driven roller upward from the driving roller, and couples the driven roller with the driving roller with turn of the turning shaft in the direction reverse to the prescribed direction;

a turning arm having a upper end connected to the other end of the turning shaft and extending downward from the upper end in a direction approximately perpendicular to the turning shaft and being turnable around the upper end;

a protrusion formed at the bottom end of the turning arm to protrude therefrom;

a second arm having a first end connected to a lower end of the turning arm, and a second end placed downstream after the first end along the delivery direction;

a second manipulating member having a turning end fixed in a turnable manner near the outlet port and connected to the second arm at the second end;

a pulling coil spring which is placed in the upstream before the second manipulating member pulls the second manipulating member in the upstream direction against the delivery direction to energize the turning arm to turn in the reverse direction; and a stopper which is placed near the inlet port and locks the turning arm by hooking the protrusion of the turning arm when the turning arm is turned in the prescribed direction.

7. The image-forming apparatus according to claim 6, which is provided with a stopper-releasing device, and a releasing device controller for controlling the stopper-releasing device.

* * * * *